US007636276B2

(12) United States Patent
Navarre

(10) Patent No.: US 7,636,276 B2
(45) Date of Patent: Dec. 22, 2009

(54) DEVICE FOR MEASUREMENT OF GEO-SOLAR TIME PARAMETERS

(76) Inventor: Alan Navarre, 18057 Coastline # 7, Malibu, CA (US) 90265

( * ) Notice: Subject to any disclaimer, the term of this patent is extended or adjusted under 35 U.S.C. 154(b) by 0 days.

(21) Appl. No.: 11/324,837

(22) Filed: Jan. 3, 2006

(65) Prior Publication Data

US 2007/0153634 A1 Jul. 5, 2007

(51) Int. Cl.
*G04B 19/26* (2006.01)
*G04C 19/00* (2006.01)

(52) U.S. Cl. ..... 368/10; 368/15; 368/17; 368/82

(58) Field of Classification Search ..... 368/10, 368/15–24, 82–84, 239, 223
See application file for complete search history.

(56) References Cited

U.S. PATENT DOCUMENTS

| | | | | | |
|---|---|---|---|---|---|
| 3,960,344 | A * | 6/1976 | Dugan | 244/182 |
| 4,204,398 | A | 5/1980 | Lemelson | |
| 4,253,169 | A * | 2/1981 | Salah | 368/15 |
| 4,316,272 | A | 2/1982 | Naito | |
| 4,479,722 | A * | 10/1984 | Salah | 368/17 |
| 4,825,426 | A * | 4/1989 | Oechslin | 368/15 |
| 4,995,020 | A | 2/1991 | Mitchell | |
| 5,457,663 | A * | 10/1995 | Mejaski | 368/15 |
| 5,896,348 | A | 4/1999 | Lyon | |
| 6,834,025 | B1 | 12/2004 | Loaiza | |
| 6,871,407 | B1 | 3/2005 | Maegli | |
| 6,912,180 | B2 | 6/2005 | Dias | |
| 6,960,975 | B1 | 11/2005 | Volfson | |
| 6,979,197 | B2 * | 12/2005 | Cho et al. | 434/136 |

FOREIGN PATENT DOCUMENTS

| | | |
|---|---|---|
| WO | WO 97/20256 | 11/1996 |
| WO | WO 98/47051 | 4/1997 |
| WO | WO 99/38053 | 1/1999 |
| WO | WO 00/28387 | 7/1999 |
| WO | WO 02/93275 | 5/2001 |
| WO | WO 02/67135 | 2/2002 |
| WO | WO 02/76061 | 3/2002 |
| WO | WO 03/025682 | 9/2002 |
| WO | WO 2004/088880 | 3/2004 |
| WO | WO 2005/041709 | 6/2004 |

OTHER PUBLICATIONS http://www.softpedia.com/get/Others/Home-Education/MaxClock.shtml.*
http://www.ginko.de/user/udomark/maxclock_latestinfo_e.html.*
http://www.ginko.de/user/udomark/maxclock_main_e. html.*

(Continued)

*Primary Examiner*—Vit W Miska

(57) ABSTRACT

Apparatus is disclosed for measuring geo-solar time parameters. Wrist-watches, clocks, and computer functionality provide, in addition to a traditional chronological parameter for a control frame of reference, several geo-solar time parameters including but not limited to distance Earth travels or has travelled between any two universal orbital points, dynamic Earth-Sun distance, and dynamic rotational velocity of Earth at any longitudinal-latitudinal point.

5 Claims, 2 Drawing Sheets

OTHER PUBLICATIONS http://www.ginko.de/user/udomark/maxclock31_descr_e. html.*
D'Espagnat, Addison Wesley. Veiled reality: an analysis of present-day Quantum Mechanical concepts. Addison Wesley, 1995.
Einstein, Albert. Relativity: The Special and the General Theory. New York: Random House, 1977.
Einstein, Albert, & Minkowski, H. The Principle of Relativity. Mineola: Dover Publications, 1977.
Halliday, D., Resnick, R. & Walker, J. Fundamentals of Physics, Fourth Edition, Extended. New York: John Wiley & Sons, Inc., 1995.
Hawking, Stephen. Brief History of Time: From the Big Bang to Black Holes. New York: Bantam Books,1998.
Kraus, Gerhard. Has Hawking Erred? London: Janus Publishing Company, 1994.
Slusher, Harold S., and Ramirez, Franciso. The Motion Of Mercury's Perihelion. El Cajon: Institute for Creation Research, 1984.
Strauss, Michael. The Collapse of Special Relativity. Pembroke Pines: Palatinate Enterprises, 2004.
Von Baeyer, Hans Christian. Taming the Atom. New York: Random House, 1992.
International Earth Rotation and Reference Systems Service. http://www.iers.org.

* cited by examiner

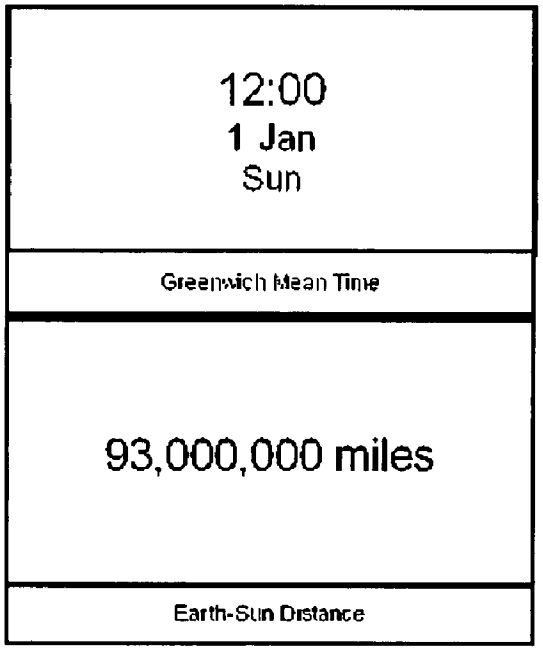
FIG 1A Wrist Watch or Clock Face: Earth-Sun Distance
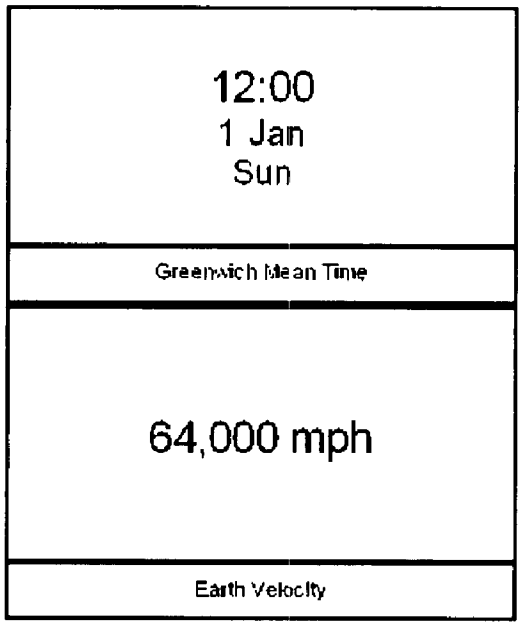
FIG. 1B. Wrist Watch or Clock Face. Earth Velocity
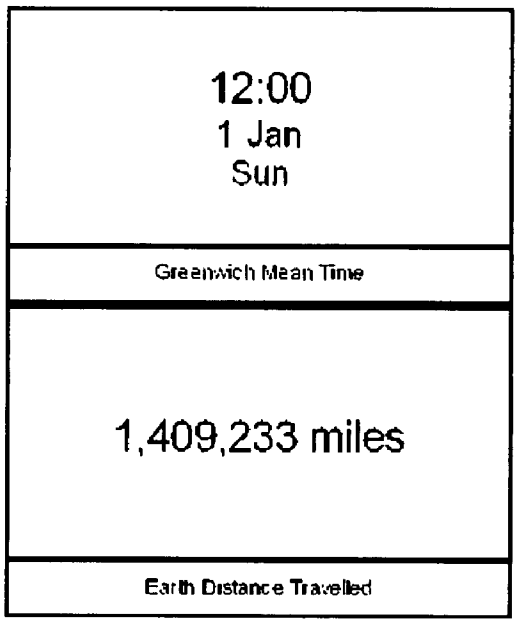
FIG 1C Wrist Watch or Clock Face: Earth Distance Travelled

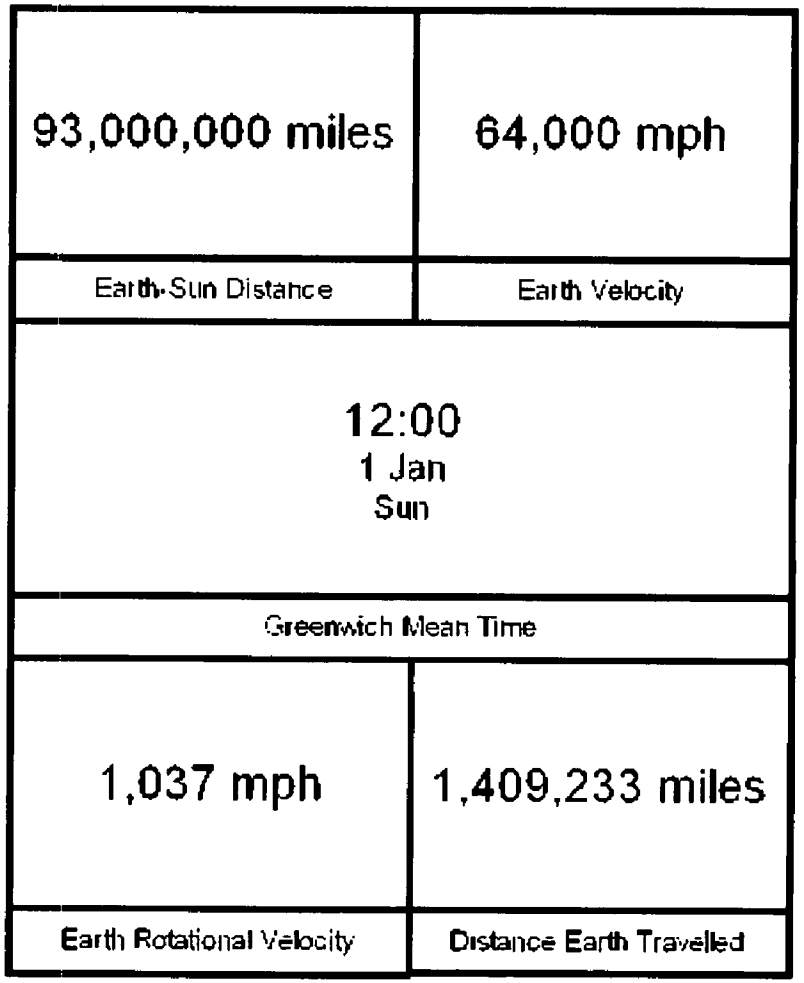
FIG 2. Wrist Watch or Clock Face; Several Parameters Display
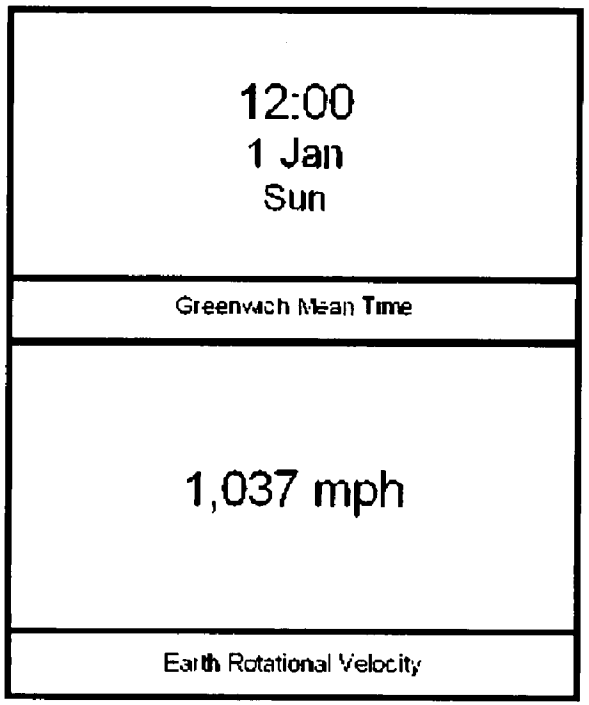
FIG. 1D. Wrist Watch or Clock Face. Earth Rotations

DEVICE FOR MEASUREMENT OF GEO-SOLAR TIME PARAMETERS

FIELD OF THE INVENTION

The present invention relates generally to horology and time measurement and more particularly to timekeeping and the geo-solar physical phenomena upon which traditional timekeeping is based.

BACKGROUND OF THE INVENTION

Time measurement and measurement of the geo-solar parameters upon which time measurement is based are needed or desired in a variety of situations, including but not limited to alternative scientific problem solving methodologies, evolution of psychological conceptual models, development of educational tools and games, and horology, wherein there is a need for an actual, physical analogue or frame of reference to traditional, abstract time.

Measurement of traditional chronological time is referenced to the four seasons of a solar cycle, the appertaining 12 or 13 lunar cycles, and 365 or 366 settings and risings of the Sun. The sundial divided the day into several equal parts. Hourglasses provided a measurement of the duration of one or more of the sundial's divisions. An array of time measurement apparati followed. Calendar-time and clock-time evolved. Time was contrived as a parameter to relate the motion of an object of mass over a distance. Time was contrived as a 4th dimension parameter to relate two separate 3-dimensional coordinate systems. When General Relativity tenets were challenged, time became differentiated and isolated as a contrived, abstract parameter as over against the actual, physical parameters distance and motion of an object of mass. When the wavelength of cesium was considered to define one second of clock-time, time measurement had come full circle, to the physical descriptions of the durations of the actual orbits of the Sun and moon, and rotations of Earth forming the basis for human observation, understanding, and description of time. The contrivance of time as a physical parameter created the sense of time as being a psychological or cognitive concept or paradigm. The present invention provides measurements of actual, physical phenomena upon which time measurement is based, as these measurements are observed and described in objective, physical terms.

SUMMARY OF THE INVENTION

The following presents a simplified summary of the invention in order to provide a basic understanding of some aspects of the invention. This summary is not an extensive overview of the invention. It is intended neither to identify key or critical elements of the invention nor to delineate the scope of the invention. Its purpose is to present some concepts of the invention in a simplified form as a prelude to the more detailed description that is presented later.

The present invention is directed to methods and apparati for measuring physical phenomena which undergird traditional time-parameter measurement methodology, which may be employed in any number of applications in which time measurements are desired, including but not limited to scientific, technological, educational, and psychological implementations. One aspect of the invention relates to the measurement of the distance which Earth travels providing an actual physical parameter or phenomenon upon which time is based.

BRIEF DESCRIPTION OF THE DRAWINGS

FIG. 1A is a view illustrating an exemplary digital wrist-watch or clock face having both a traditional time measurement panel and a panel displaying the geo-solar parameter measurement of dynamic Earth-Sun distance.

FIG. 1B is a view further illustrating details of the exemplary digital wrist-watch or clock face of FIG. 1A, displaying in the geo-solar parameters panel the dynamic velocity of Earth moving along its universal solar orbital trajectory.

FIG. 1C is a view further illustrating details of the exemplary digital wrist-watch or clock face of FIG. 1A, displaying in the geo-solar parameters panel the dynamic distance Earth has travelled between any two points.

FIG. 1D is a view further illustrating details of the exemplary digital wrist-watch or clock face of FIG. 1A, displaying in the geo-solar parameters panel the dynamic axis-rotational velocity of Earth.

FIG. 2 is a view illustrating an exemplary digital wrist-watch or clock face having a traditional time measurement display panel and several panels displaying geo-solar parameters measurements.

DETAILED DESCRIPTION OF THE INVENTION

The present invention will now be described with reference to the attached drawings, wherein like reference numerals are used to refer to like elements throughout. The invention relates to apparatus measuring time based on geo-solar parameters, for example, dynamic velocity of Earth along Earth's universal solar orbital trajectory (FIG. 1B, lower display panel), which may be associated to universal timekeeping or other methodologies in which time measurements based on geo-solar parameters are desired (e.g., alternative scientific problem solving, educational tools and games, transformation of psychological paradigms, etc.). Although illustrated and described hereinafter in the context of an exemplary geo-solar parameters based timekeeping instrument, the time measurement aspects of the invention and the appended claims are not limited to employment in association with horology.

In traditional time measurement systems, accuracy is based on synchronicity with geo-solar parameters. One difficulty with this methodology relates to the fact that it represents time as a concrete or physical phenomenon. For example, the digital numerical display of "12:00" (FIG. 1A, upper panel) is purely arbitrary, but is generally accepted as absolute and associated inextricably to the percepts of "noon" and "midnight." Referring to FIGS. 1A through ID (lower display panels), geo-solar phenomena, upon which traditional time measurement is based, progress independently of arbitrary time measurement systems, such as International Atomic Time (TAI), whose unit of time measurement is the Systeme International second, defined as the duration of 9,192,631,770 cycles of radiation corresponding to the transition between two hyperfine levels of the ground state of the cesium 133 atom.

Further complexities in this methodology relate to the fact that traditional time measurement systems impose an apparent, absolute frame of reference with regard to time. Coordinated Universal Time (UTC), the basis for civil time, distributes its system across 24 longitudinal time zones whose "point zero," or point of origin, lies along the Greenwich Meridian at arbitrary 0°0'0" longitude. Einstein's Theory of Special Relativity proposed the existence of relative frames of reference with regard to time; however impractical in its applications, Einstein's theoretical model demonstrated the conceptual need for relative frames of reference with regard to time in physical problem solving, for example, the continual adjustment of clocks to synchronize with geo-solar paramenters. To reiterate, referring to FIGS. 1A through 1D, lower display panels, geo-solar phenomena (Earth's rotation about its axis, Earth's revolution about the Sun) progress independently of traditional time measurement.

Because the present invention comprises a microchip, standard to digital chronometers, the upper panel can display date and weekday, and change modes between 12-hour and 24-hour time bases. The invention also incorporates the capability, in accordance with one or more integral aspects thereof, to change modes among several different geo-solar parameters, displaying one such parameter at a time (FIGS. 1A-1D, lower display panels). The microchip is also encoded with geo-solar parameters algorithms. The Distance Earth Travelled geo-solar parameter (FIG. 1C, lower display panel) incorporates the functionality similar to that of a traditional stopwatch, which measures the amount of time elapsing between one specific time when activated and another specific time when deactivated. With a larger display area, in the instance of FIG. 2, a greater number of geo-solar parameters can be displayed simultaneously. The invention also incorporates the capability of mode changing from US-UK standard to Systeme International (SI) metric measurement units.

Another example of the complexity in traditional time measurement methodology is evinced by the U.S. Naval Observatory's procedure of introducing a leap second annually into the UTC system in order to synchronize with the TAI system (referenced above). For example, one (positive) second will be added at midnight, 31 Dec. 2005-1 Jan. 2006. Furthermore, there are several separate time measurement systems under continuous monitoring with regard to time synchronization: TAI, UTC, UT, UT0, UT1, Dynamical Time, Terrestrial Time (or Terrestrial Dynamical Time), Barycentric Dynamical Time, Geocentric Coordinate Time, Barycentric Coordinate Time, and Sidereal Time. While the present invention does not propose to provide "correct" time measurement by calibration against the known standards of traditional time measurement systems, it does take a step towards an algorithm(s) comprising the many factors currently involved in traditional time measurement systems, and underscores à la Special Relativity Theory the need for general comprehension on a practical level the theoretical concept of time and how time relates to both physical parameters and psychological percepts. For example, the Earth-Sun distances and Earth's velocities marked at the aphelion and perihelion embody factors necessary towards the evolution of an improvement in time measurement methodology.

Although the invention has been illustrated and described with respect to one or more implementations, equivalent alterations and modifications will occur to others skilled in the art upon the reading and understanding of this specification and the annexed drawings. Furthermore, to the extent that the terms "including", "includes", "having", "has", "with", or variants thereof are used in either the detailed description and the claims, such terms are intended to be inclusive in a manner similar to the term "comprising."

What is claimed is:

1. A wearable chronometric display apparatus for displaying auxiliary parameters generated by installed software, said apparatus comprising:

a first display window for displaying current time featuring hours and minutes corresponding to a specific timezone;

a second display window for displaying the parameters;

a programmable chip for determining the current time and the parameters; and a housing containing the programmable chip and the first and second display windows, the housing further including a strap for wearing on a wrist;

wherein the parameters include: the speed magnitude along Earth's orbital trajectory around the Sun, an arc distance traversed by the Earth between first and second orbital positions, and the Earth's rotational speed corresponding to a geographic surface position about Earth's polar axis.

2. The display apparatus of claim 1, wherein the hours are interchangeably displayed as one of a 12-hour cycle and a 24-hour cycle.

3. The display apparatus of claim 1, wherein the parameters include a radial distance between Earth and Sun.

4. The display apparatus of claim 1, wherein the parameters are displayed one at a time in said second display window.

5. The display apparatus of claim 1, wherein said second display window comprises a plurality of windows for simultaneously displaying said parameters.

* * * * *